US007070213B2

(12) United States Patent
Willats et al.

(10) Patent No.: US 7,070,213 B2
(45) Date of Patent: Jul. 4, 2006

(54) DOOR RELEASE AND ENGAGEMENT MECHANISM

(75) Inventors: Robin H. Willats, Preston (GB); John Emson, West Midlands (GB); Sidney E. Fisher, Redditch (GB); Gurbinder S. Kalsi, West Midlands (GB); Nigel V. Spurr, Solihull (GB); Jean B. Didier, Anould (FR); Alan G. Dixon, Chester (GB); Stephen P. Drysdale, Northampton (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 0 days.

(21) Appl. No.: 10/245,867

(22) Filed: Sep. 16, 2002

(65) Prior Publication Data

US 2003/0052490 A1 Mar. 20, 2003

(30) Foreign Application Priority Data

Sep. 20, 2001 (GB) ..... 0122634.9

(51) Int. Cl.
*E05C 3/06* (2006.01)

(52) U.S. Cl. ..... 292/216; 292/201; 292/336.3; 292/DIG. 23

(58) Field of Classification Search ..... 292/DIG. 42, 292/DIG. 43, 201, 216, DIG. 23, 336.3
See application file for complete search history.

(56) References Cited

U.S. PATENT DOCUMENTS 3,020,076 A 2/1962 Biondo
4,616,862 A * 10/1986 Ward ..... 292/201
4,900,074 A * 2/1990 Kleefeldt et al. ..... 292/216
4,972,182 A * 11/1990 Novik et al. ..... 340/5.25
5,234,237 A * 8/1993 Gergoe et al. ..... 292/201
5,236,234 A * 8/1993 Norman ..... 292/201
5,468,042 A * 11/1995 Heinrichs et al. ..... 296/146.4
5,504,377 A * 4/1996 Nowell ..... 307/10.1
5,511,838 A * 4/1996 Baughman et al. ..... 292/336.3
5,613,717 A 3/1997 Ha
5,667,259 A * 9/1997 Torkowski ..... 292/201
5,702,136 A * 12/1997 Funk et al. ..... 292/336.3
5,844,470 A * 12/1998 Garnault et al. ..... 340/5.62
5,884,515 A * 3/1999 Milman ..... 70/472
5,901,991 A * 5/1999 Hugel et al. ..... 292/201
5,929,769 A * 7/1999 Garnault ..... 340/5.61
5,944,369 A * 8/1999 Kapes ..... 292/336.3
5,961,164 A * 10/1999 Gomi ..... 292/216
6,010,165 A * 1/2000 Santarelli et al. ..... 292/216

(Continued)

FOREIGN PATENT DOCUMENTS

FR 1 132 650 A 3/1957

(Continued)

OTHER PUBLICATIONS

Patents Act 1977, Search Report under Section 17 dated Dec. 28, 2001.

*Primary Examiner*—Brian E. Glessner
*Assistant Examiner*—Carlos Lugo
(74) *Attorney, Agent, or Firm*—Barnes & Thornburg LLP

(57) ABSTRACT

A door release and engagement mechanism for a vehicle comprising a combined inside release and door pull handle and a latch operably connected thereto, wherein the mechanism is so constructed and arranged as to disable the operable connection when the door is ajar and/or unlatched so as to prevent the latch from being mis-set prior to subsequent re-closure of the door.

10 Claims, 5 Drawing Sheets

U.S. PATENT DOCUMENTS

| | | | | |
|---|---|---|---|---|
| 6,050,117 | A * | 4/2000 | Weyerstall | 70/277 |
| 6,199,923 | B1 * | 3/2001 | Rice et al. | 292/216 |
| 6,247,343 | B1 * | 6/2001 | Weiss et al. | 70/277 |
| 6,247,732 | B1 * | 6/2001 | Alton | 292/216 |
| 6,267,420 | B1 * | 7/2001 | Miyagawa | 292/216 |
| 6,367,295 | B1 * | 4/2002 | Agostini et al. | 70/257 |
| 6,374,652 | B1 * | 4/2002 | Hwang | 70/277 |
| 6,390,529 | B1 * | 5/2002 | Bingle et al. | 296/76 |
| 6,517,128 | B1 * | 2/2003 | Perkins et al. | 292/216 |
| 6,519,987 | B1 * | 2/2003 | Weyerstall | 70/257 |
| 6,522,241 | B1 * | 2/2003 | Baudard | 340/5.61 |
| 6,527,313 | B1 * | 3/2003 | Takahashi et al. | 292/336.3 |
| 6,536,814 | B1 * | 3/2003 | Kachouh | 292/216 |
| 6,543,823 | B1 * | 4/2003 | Baudard | 292/216 |
| 6,556,125 | B1 * | 4/2003 | Rohrl | 340/5.62 |
| 6,575,003 | B1 * | 6/2003 | Dupont | 70/257 |
| 6,577,228 | B1 * | 6/2003 | Tsuchida et al. | 340/5.72 |
| 6,617,961 | B1 * | 9/2003 | Janssen et al. | 340/5.8 |
| 6,719,333 | B1 * | 4/2004 | Rice et al. | 292/216 |
| 2001/0010489 | A1 * | 8/2001 | Baudard | 340/5.72 |

FOREIGN PATENT DOCUMENTS

| | | |
|---|---|---|
| FR | 2 761 101 A | 9/1998 |
| GB | 779 517 A | 7/1957 |
| GB | 2 353 321 A | 2/2001 |

* cited by examiner

DOOR RELEASE AND ENGAGEMENT MECHANISM

This application claims priority to Great Britain Patent Application (GB) 0122634.9 filed on 20 Sep. 2001.

BACKGROUND OF THE INVENTION

The present invention relates to a door release and engagement mechanism. More particularly, the present invention relates to a door release and engagement mechanism for a vehicle.

Typically, vehicle doors and in particular vehicle passenger doors are provided with a separate inside door engagement means such as a pull handle and inside release means such as an inside release handle. The use of two separate components for these functions inevitably increases the part count and door assembly time and hence the overall assembly cost. It also restricts the design freedom of the inside door trim upon which these components are typically mounted.

In vehicles fitted with a power unlatching system, pulling the inside release handle merely operates an electrical switch that sends an unlatching signal to the corresponding door latch. Nevertheless, it is desirable to include a mechanical connection between the release handle and the latch so that users may be able to exit the vehicle even when there is a loss of power to the latch.

SUMMARY OF THE INVENTION

The present invention seeks to overcome or at least mitigate the aforesaid problems.

One aspect of the present invention provides a door release and engagement mechanism for a vehicle comprising a combined inside release and door pull handle and a latch operably connected thereto, wherein the mechanism is so constructed and arranged as to disable the operable connection when the door is ajar and/or unlatched so as to prevent the latch from being mis-set prior to subsequent re-closure of the door.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
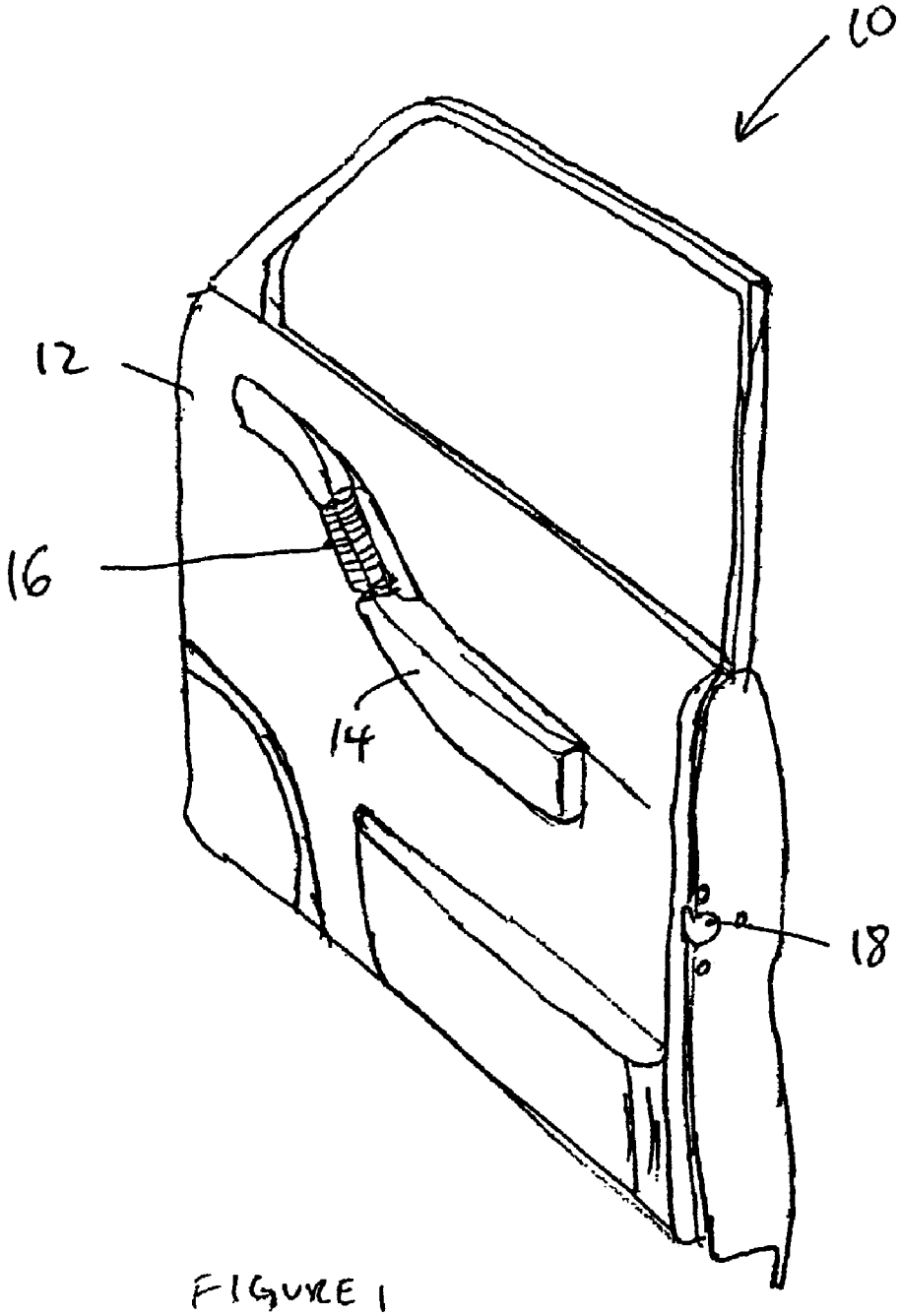
FIG. 1 is a perspective view of a vehicle door incorporating a mechanism according to the present invention.

Referring to FIG. 1, a door 10 comprises an interior trim panel 12 having an arm rest portion 14 provided thereon. Integral with the arm rest is a handle 16 that has the dual function of unlatching a latch 18 provided on the door 10 when the door is closed so as to enable the user to exit a vehicle (not shown) to which the door is fitted, and also to pull the door into a closed position when it is ajar (not closed). Generally, the simple combination of these function would not work since pulling on a single handle to close the door would prevent the corresponding latch from being latched at precisely the moment when latching should occur. This is because a pawl of the latch would be lifted clear from a latch bolt of the latch.

As described in further detail below, in this embodiment the handle 16 is operably connected to the latch by a mechanical connection and an electrical connection. In normal use, actuating the handle 16 closes a switch 52 and thereby sends an electrical signal to a power actuator 54 that causes the latch 18 to unlatch. Further, if the electrical power in the vehicle fails due to a flat battery, for example, a mechanical connection enables the latch 18 to be manually unlatched.

Figure 2A:
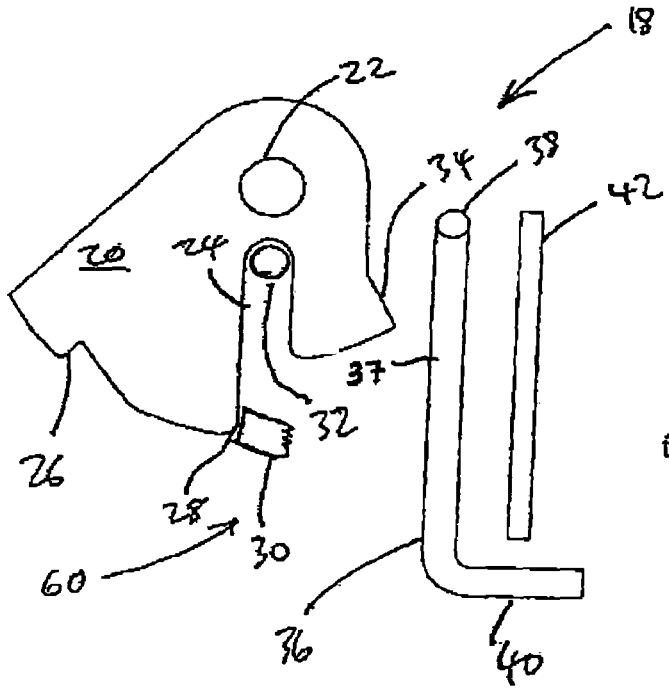
FIGS. 2A and 2B are side and end elevational views respectively of a latch of the present invention in a latched state.
Figure 2B:
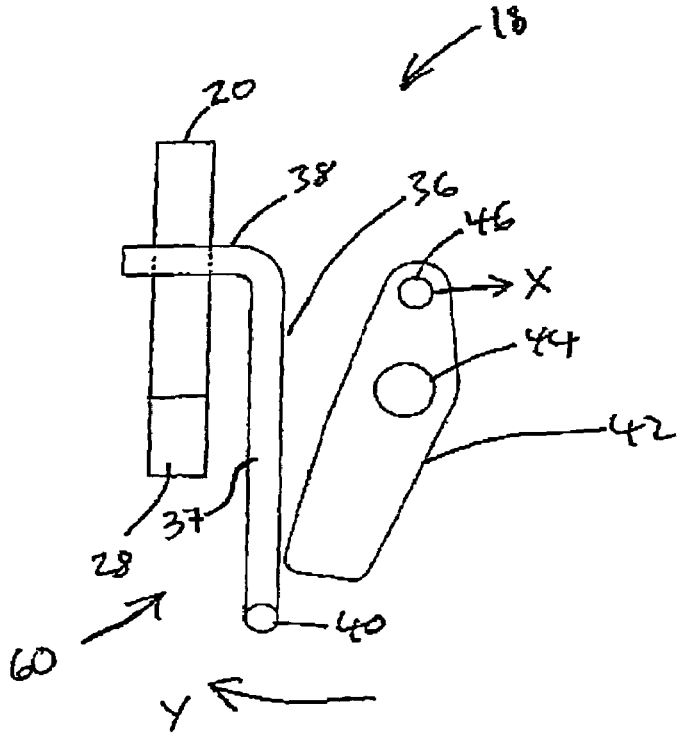

Considering first the mechanical connection, FIGS. 2A and 2B illustrate the latch 18 in a latched condition and in particular those parts constituting the mechanical connection between handle 16 and the latch 18. The latch 18 comprises a latch bolt in the form of a claw 20 rotatably mounted about a pivot 22 to a latch chassis (not shown) and having a recess 24 which retains a striker 32 when the latch 18 is latched. The claw 20 further comprises a first abutment surface 26 for a first safety latched position and a second abutment surface 28 against which pawl 30 abuts to retain the claw 20 in a fully latched condition. Pawl 30 is resiliently biased into contact with claw 20. The latch 18 further comprises an inside release lever 42 rotatably mounted to the latch chassis about a pivot 44.

The lever 42 is connected to the handle 16 by a rod or cable (not shown) mounted to a pivot 46 such that actuating the handle 16 pulls the cable or rod in a direction X thereby causing the lever to pivot clockwise in a direction Y as shown in FIG. 2B and this is well known. The inside release lever 42 is in turn connected by a linkage (not shown) of known type to the pawl 30 such that when the lever 42 pivots in direction Y the pawl 30 lifts.

A block link 36 is mounted for slidable movement in a vertical plane only intermediate claw 20 and lever 42. The link 36 comprises a substantially vertically arranged bar 37 having a substantially horizontally positioned claw abutment projection 38 formed integrally therewith at the upper end of the bar. A substantially horizontally arranged lever abutment projection 40 is formed integrally with the lower end of the bar 37. When viewed along the longitudinal axis of the bar 37, projections 38 and 40 are angled at substantially 90° to each other. As can be seen most clearly from FIG. 2B, when the latch 18 is in a latched condition, the block link is arranged such that it does not impede rotation of lever 42.

Figure 3A:
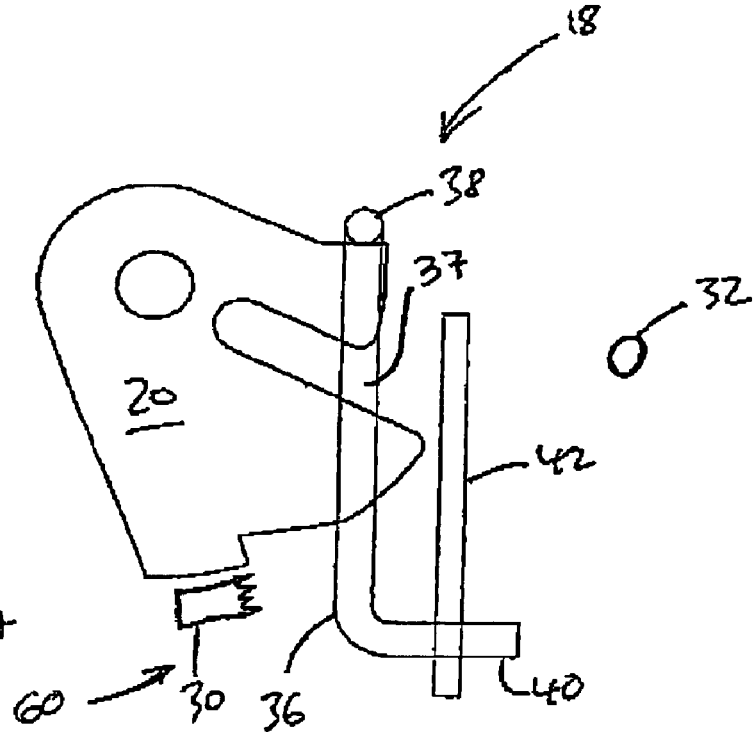
FIGS. 3A and 3B are side and elevational views of the latch of FIGS. 2A and 2B in an unlatched state.
Figure 3B:
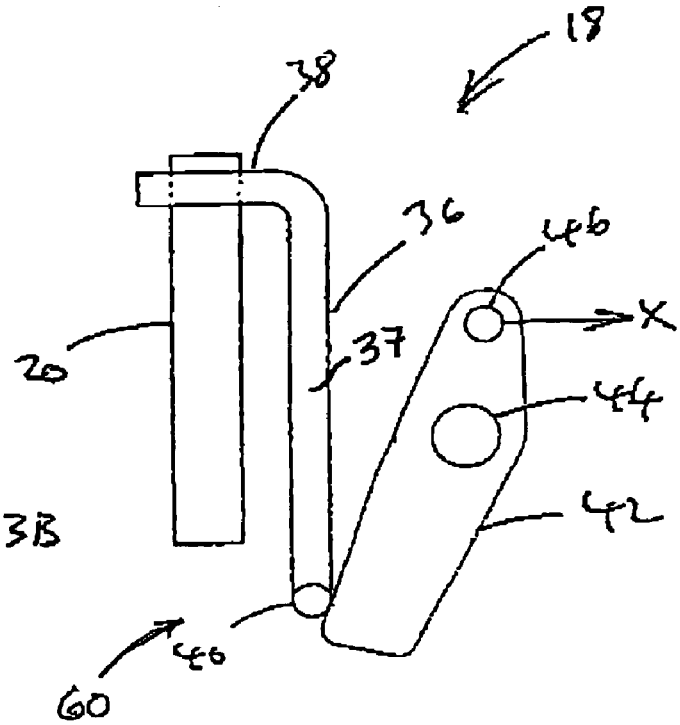

Turning now to FIGS. 3A and 3B, the latch 18 is shown in an unlatched condition with the door open (note striker 32 is no longer retained in recess 24). Unlatching occurs via a user actuating either the inside handle 16 or outside release handle (not shown) thereby causing pawl 30 to lift out of abutment with either of surfaces 26 or 28. Because claw 20 is biased in an anti-clockwise direction as shown in FIG. 3A, anti-clockwise rotation of the claw 20 occurs, thereby releasing striker 32. This simultaneously causes block link 36 to be engaged by an abutment surface 34 of the claw 20 and thus to be lifted. As can be seen most clearly from FIG. 3B, in this position it is not possible for lever 42 to further actuate pawl 30 since rotation of lever 42 is prevented by projection 40. Therefore, when the user pulls handle 16 in order to close and latch the door 10, this pulling action is prevented from causing the latching action to fail due to the pawl 30 being lifted out of contact with the claw 20 as the claw 20 rotates during contact with the striker 32.

It is apparent that activation of lever 42 in direction X maintains the blocking link 36 in its lifted position even whilst claw 20 rotates clockwise during contact with the striker 32. Only once actuation of lever 42 ceases (when the door 10 is closed and the latch is latched) will blocking link 36 return to its rest position enabling a subsequent actuation of lever 42 to release the latch 18. Pawl 30, block link 36, and lever 42 are included in a release linkage 60.

Figure 4:
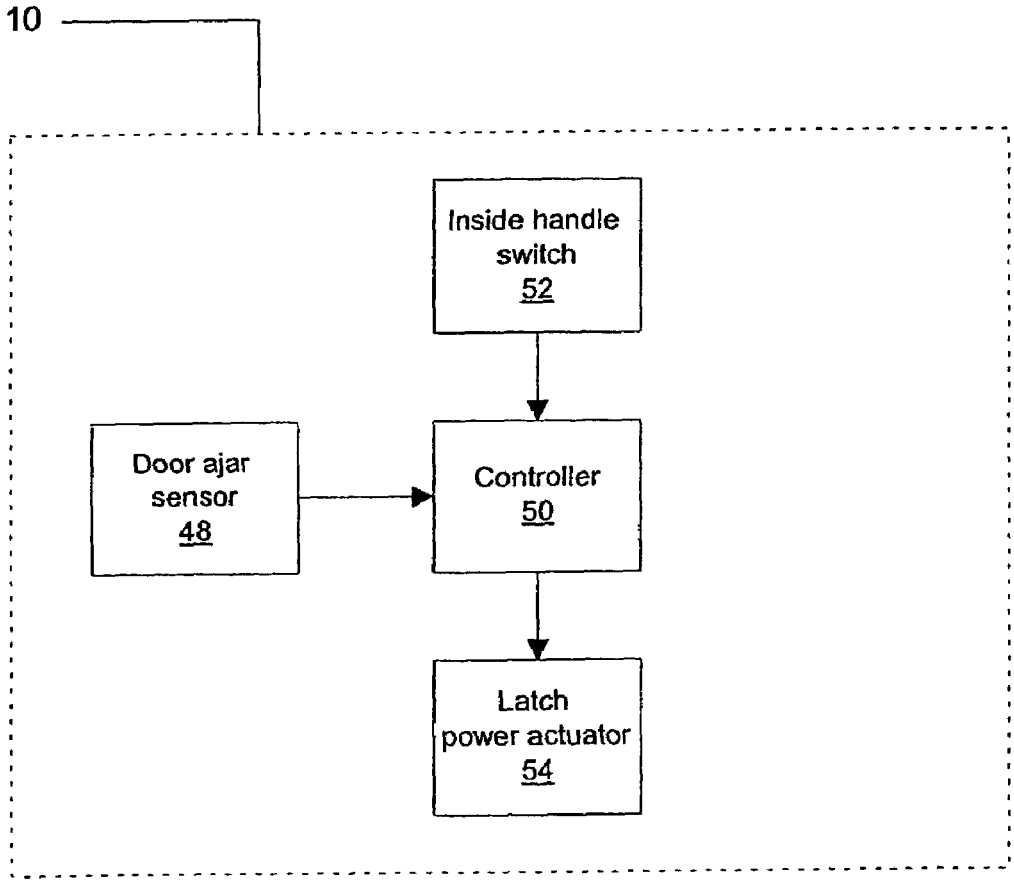
FIG. 4 is a schematic diagram of a vehicle having a door incorporating the present invention.

FIG. 4 illustrates schematically the electrical mechanism constituting the operable connection between inside handle 16 and latch 18 mounted in the door is of a vehicle 60. It can be seen that the mechanism comprises an inside handle switch 52 arranged so as to signal a controller 50 when the handle 16 is actuated and a door ajar sensor 48 arranged so as to signal the controller 50 when the door 10 is ajar (open). The controller 50 may be in the form of a stand-alone microprocessor located within the door 10 as shown in FIG. 4 or a vehicle ICU which may be located under the bonnet of the vehicle, for example. In response to the input signals from switch 52 and sensor 48, the controller 58 determines whether latch power actuator 54 (e.g. an electric motor) is to cause the unlatching of the latch 18 and signals the actuator accordingly. The power actuator 54 is arranged so as to lift pawl 30 when an unlatching signal is sent by controller 50. In use, the controller 50 does not send an unlatching signal to the actuator 54 when sensor 48 indicates that the door is ajar.

Figure 5:
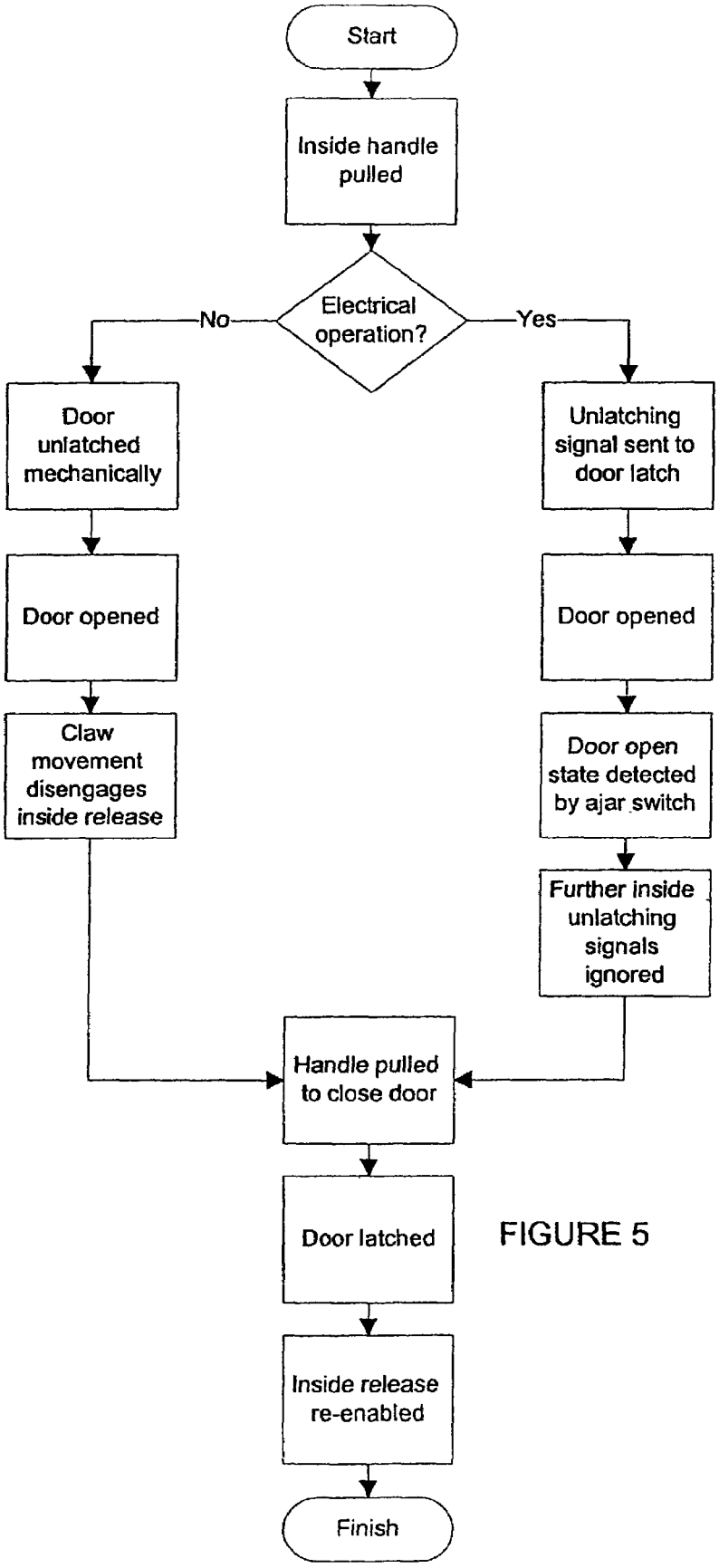
FIG. 5 is a flow chart illustrating the functioning of the invention.

The operational sequence of the mechanism is illustrated by a flow chart of FIG. 5. In order to determine whether the latch is to be operated electrically, in one embodiment a small force applied to handle 16 is sufficient to cause the latch to be unlatched electrically, but that if electrical operation is not possible, a larger force must be exerted on the handle 16 to cause mechanical unlatching. Thus, electrical unlatching takes precedence.

It is therefore apparent that both the electrical and mechanical connections are provided with safeguards to prevent the latch being mis-set when the door is being pulled to a closed position, enabling a single handle 16 to act as door engagement means and inside release means.

It should be noted that references to orientations such as "vertical" and directions such as "anticlockwise" have been used for convenience within the description and are not to be considered as limiting.

It should be understood that numerous changes may be made within the scope of the present invention. For example, a break rather than a block may be provided in the latch linkage to prevent the latch being mis-set and the mechanism may be adapted for use with other known types of latches. The choice between electrical and mechanical unlatching may be left to the vehicle user by, for example, electrical unlatching being initiated by pulling handle 16 inwardly and mechanical actuation by lifting the handle upwardly. In this embodiment, the block link may be dispensed with since mechanical unlatching would not be caused by pulling the door into a closed position under normal operational circumstances. Rather than the electrical connection comprising a door ajar sensor, a sensor to determine the state of the latch could be employed. The door ajar sensor may be provided in series with the inside handle switch and in which case, a controller may be dispensed with.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A door release and engagement mechanism for a pivoting door for a vehicle comprising:

a handle operable as both an inside release and a door pull handle to pull the door from an angled, open position with respect to the vehicle to a closed, aligned position with respect to the vehicle, a latch connected to the handle by an operable connection, and means for disabling the operable connection between the latch and the handle as a result of the door being in an ajar condition, such that when the handle moves the door from the open position to the closed position the latch is in a condition to latch the door in response to the door assuming the closed position, wherein the operable connection is an electrical connection.

2. The mechanism according to claim 1 wherein the electrical connection includes one of a sensor and a switch arranged to determine whether the door is ajar.

3. The mechanism according to claim 2 wherein the one of a sensor and a switch is arranged in series with an electrical output of the handle.

4. The mechanism according to claim 2 wherein the electrical connection further includes a controller and a handle switch and the one of a sensor and a switch and handle switch provide separate inputs to the controller.

5. A door release and engagement mechanism for a vehicle comprising:

a handle operable as both an inside release and a door pull handle, a latch connected to the handle by an electrical operable connection, and means for disabling the operable connection between the latch and the handle when the handle moves the door from an open position to a closed position such that the latch is in a condition to latch the door in response to the door assuming the closed position, the mechanism further comprising a mechanical connection, the mechanical connection being configured to operate if the electrical connection is non-functional.

6. The mechanism according to claim 5 wherein the disabling means is configured to disable the operable connection between the latch and the handle as a result of the door being in an ajar condition, such that when the handle moves the door from the open position to the closed position the latch is in a condition to latch the door in response to the door assuming the closed position.

7. A door release and engagement mechanism for a pivoting door for a vehicle comprising:

a handle operable as both an inside release and a door pull handle to pull the door from an angled, open position with respect to the vehicle to a closed, aligned position with respect to the vehicle, a latch connected to the handle by an operable connection, and means for disabling the operable connection between the latch and the handle as a result of the door being in an ajar condition, such that when the handle moves the door from the open position to the closed position the latch is in a condition to latch the door in response to the door assuming the closed position, wherein the operable connection is a mechanical connection, a block is provided in a release linkage of the latch when the door is ajar, the block is provided in the linkage by a block link arranged to disable operation of the linkage when the latch is unlatched and to permit operation of the linkage when the latch is latched, and the block link is arranged to move between a blocked position and an unblocked position due to rotation of a claw of the latch.

8. The mechanism according to claim 7 wherein actuation of an inside release lever of the latch is substantially prevented in the blocked position.

9. A door comprising:

a hinge for pivotally mounting the door to a vehicle;

a door release and engagement mechanism for the vehicle, the mechanism comprising (i) a handle operable as both an inside release and a door pull handle, (ii) a latch connected to the handle by an electrical operable connection, and (iii) means for disabling the operable connection between the latch and the handle as a result of the door being in an ajar condition, such that when the handle moves the door from an open position to a closed position the latch is in a condition to latch the door in response to the door assuming the closed position.

10. A vehicle comprising a door, the door being pivotally mounted to the vehicle and including:

a door release and engagement mechanism for the vehicle, the mechanism comprising (i) a handle operable as both an inside release and a door pull handle, (ii) a latch connected to the handle by an electrical operable connection, and (iii) means for disabling the operable connection between the latch and the handle as a result of the door being in an ajar condition, such that when the handle moves the door from an open position to a closed position the latch is in a condition to latch the door in response to the door assuming the closed position.

* * * * *